US007956827B2

(12) United States Patent
Chu et al.

(10) Patent No.: US 7,956,827 B2
(45) Date of Patent: Jun. 7, 2011

(54) DRIVING CIRCUIT USING PULSE WIDTH MODULATION TECHNIQUE FOR A LIGHT EMITTING DEVICE

(75) Inventors: Chih-Heng Chu, Tainan County (TW); Ming-Cheng Chiu, Tainan County (TW)

(73) Assignee: Himax Technologies Limited (TW)

( * ) Notice: Subject to any disclaimer, the term of this patent is extended or adjusted under 35 U.S.C. 154(b) by 913 days.

(21) Appl. No.: 11/177,098

(22) Filed: Jul. 8, 2005

(65) Prior Publication Data

US 2007/0008254 A1 Jan. 11, 2007

(51) Int. Cl.
*G09G 3/30* (2006.01)

(52) U.S. Cl. ..... 345/77; 313/484

(58) Field of Classification Search ..... 345/76, 345/82; 313/484
See application file for complete search history.

(56) References Cited

U.S. PATENT DOCUMENTS 4,996,523 A 2/1991 Bell et al.
6,023,259 A 2/2000 Howard et al.
2005/0219163 A1* 10/2005 Smith et al. ..... 345/76
2006/0050032 A1* 3/2006 Gunner et al. ..... 345/82
2007/0046611 A1* 3/2007 Routley et al. ..... 345/98

OTHER PUBLICATIONS

Texas Instrument Synchronous 4-Bit Counters, Texas Instruments, SDLS060-Oct.1976-Revised Mar. 1988.*

* cited by examiner

*Primary Examiner* — Amare Mengistu
*Assistant Examiner* — Vinh Lam
(74) *Attorney, Agent, or Firm* — Baker & McKenzie LLP

(57) ABSTRACT

A current driving apparatus and method using a pulse width modulation (PWM) technique to display a desired gray level for passive matrix organic light emitting diode (PMOLED) display applications is disclosed. The current driving circuit includes a memory, a logic and a segment driver. The memory stores a desired gray level, the logic comprises a counter and provides a predetermined bias time, and the segment driver provides a constant current to the PMOLED display based on the desired gray level and the predetermined bias time. The segment driver provides a constant current to the PMOLED display until the counter value reaches the desired gray level, and the counter is first counted zero for the predetermined bias time and then increments by one for every other cycle.

19 Claims, 7 Drawing Sheets

DRIVING CIRCUIT USING PULSE WIDTH MODULATION TECHNIQUE FOR A LIGHT EMITTING DEVICE

BACKGROUND OF THE INVENTION

1. Field of the Invention

This invention relates to a light emitting display technology, and more particularly to a current driving method using a pulse width modulation (PWM) technique to display a desired gray level for passive matrix organic light emitting diode (PMOLED) display applications.

2. Description of the Related Art

In modern days, video display devices play an important role in our daily lives. Information and communication routinely are transmitted and then displayed on those devices. Generally, display devices are classified into luminous types and non-luminous types. Luminous type display devices include cathode ray tubes (CRT) and light emitting diodes (LED), while non-luminous type displays include liquid crystal displays (LCD) and the likes.

LCD displays offer the advantages of compactness and power saving, in comparison with conventional CRT displays. However, the drawbacks of long response time, poor contrast and limited viewing angle drive the need for improved technologies. One of the promising display technologies called organic light emitting diode (OLED) display has been developed by Bell et al. of Kodak and described in An OLED display is an electronic device made by placing a series of organic thin films between two conductors. When electrical currents are applied, a bright light is emitted. OLED displays not only have the favorable characteristics of greater brightness, fast response time, fuller viewing angles and power efficiency over LCD displays, they also are lightweight, compact, and durable with relatively low cost of manufacture. OLED displays are ideal for portable applications. Like LCD devices, OLED displays can be classified into passive matrix mode and active matrix mode. Illumination of an OLED pixel is controlled by a pixel circuit that may include either a source of current or a source of voltage. It is generally recognized that the constant current method provides a greater uniformity of luminance from the arrays of pixels. This is because the dependence of luminance upon current tends to be more uniform while luminance at a given voltage to the various pixels tends to be less uniform.

Passive or conventional matrix driving is generally used for low-resolution OLED displays. However, passively driven resolution is presently limited in the OLED technology to about 100-200 rows for 100 candelas/$m^2$ display brightness levels. Such displays are limited in applications to mobile telephones and mobile video equipment. For example U.S. Pat. No. 6,023,259 to Howard Shin et al. discloses a current driver that provides a passive matrix drive current to an OLED (the entire disclosure of which is herein incorporated by reference).

Referring now to FIG. 1, it illustrates how a conventional PMOLED array works according to the prior art. Control of the luminance of an "on" pixel 100 is commonly achieved by controlling a magnitude of analog voltages that determine whether the column driver voltage exceeds a threshold voltage of the pixel. A traditional manner of changing a displayed image is for a processor to update a memory for a display controller that periodically and individually addresses each of the pixels of the display, and turns them "on" (ON) or "off" (OFF) or to any luminance level in between as required.

Conventionally, in order to create gradation for the tone of each pixel, a so-called pulse width modulation (PWM) technique is used. If the pixel can display 64 gray levels, 64 pulse signals of 0 to 63 with different pulse widths are programmed for driving pixels, and the driving time is proportional to the gray level. However, it is quite complicated to implement the PWM technique for higher resolutions. Therefore, there is still a need to further improve the current driving scheme of the PWM technique for PMOLED display device applications to effectively solve the above-mentioned problems of the prior art.

SUMMARY OF THE INVENTION

The present invention is directed to solving these and other disadvantages of the prior art. The present invention provides a current driving apparatus using a pulse width modulation (PWM) technique to display a desired gray level for passive matrix organic light emitting diode (PMOLED) display applications. The present invention also eliminates some of the necessary elements in the current driving circuit; therefore, a small sized and cost effective driver IC can be achieved.

One aspect of the present invention contemplates a current driving apparatus using a pulse width modulation (PWM) technique to display a desired gray level for passive matrix organic light emitting diode (PMOLED) display applications. The current driving circuit includes a memory, a logic and a segment driver. The memory is used for storing a desired gray level, the logic is used for providing a predetermined bias time, and the segment driver is used for providing a constant current to the light emitting device based on the desired gray level and the predetermined bias time. The constant current driving time provided by the segment driver is either obtained from an empirical equation or based on a look up table of the desired gray level and the predetermined bias time.

Another aspect the present invention provides a current driving apparatus using a pulse width modulation (PWM) technique to display a desired gray level for passive matrix organic light emitting diode (PMOLED) display applications. The current driving circuit includes a memory, a logic and a segment driver. The memory is used for storing a desired gray level, the logic comprises a counter used for providing a predetermined bias time, and the segment driver is used for providing a constant current to the light emitting device based on the desired gray level and the predetermined bias time. The segment driver provides a constant current to the light emitting device until the counter reaches the desired gray level, and the counter first remains at zero for the predetermined bias time and then is incremented by one for every other cycles.

Yet another aspect the present invention provides a current driving method using a pulse width modulation (PWM) technique to display a desired gray level for passive matrix organic light emitting diode (PMOLED) display applications. The driving method comprises the steps of providing said desired gray level and a bias time; and providing a constant current to said light emitting device based on the desired gray level and the bias time. The constant current driving time is either obtained from an empirical equation or based on a look up table of the desired gray level and the predetermined bias time.

BRIEF DESCRIPTION OF THE DRAWINGS

The accompanying drawings are included to provide a further understanding of the present invention, and are incorporated in and constitute a part of this description. The drawings illustrate embodiments of the present invention, and together with the description, serve to explain the principles of the present invention.

DESCRIPTION OF THE PREFERRED EMBODIMENTS

The invention disclosed herein is directed to a current driving apparatus using a pulse width modulation (PWM) technique to display a desired gray level for passive matrix organic light emitting diode (PMOLED) display applications. In the following description, numerous details are set forth in order to provide a thorough understanding of the present invention. It will be appreciated by one skilled in the art that variations of these specific details are possible while still achieving the results of the present invention. In other instances, well-known backgrounds are not described in detail in order not to unnecessarily obscure the present invention.

Figure 1:
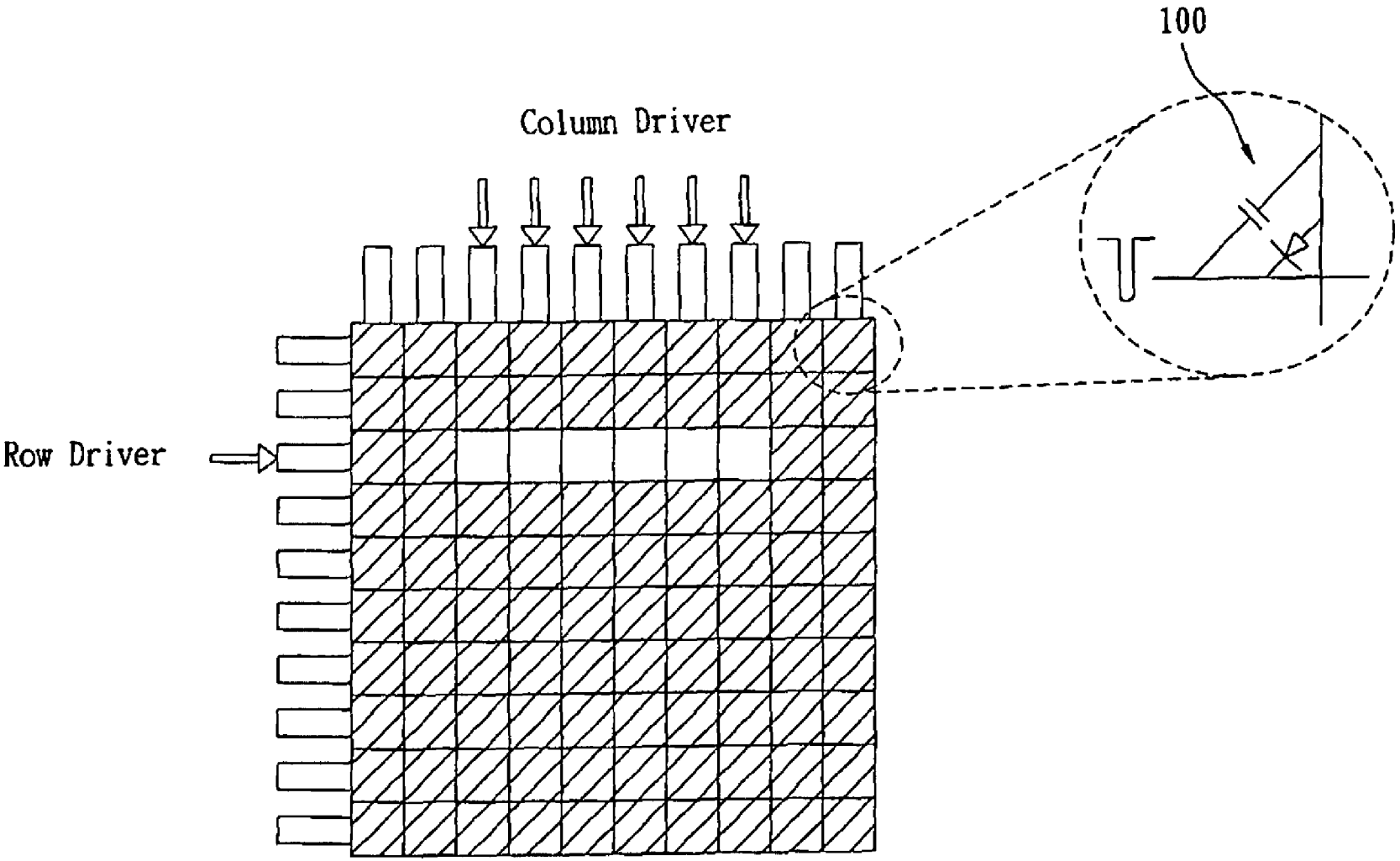
Figure 1 (Prior Art)
FIG. 1 illustrates a schematic diagram of how a conventional PMOLED array works according to the prior art.
Figure 2:
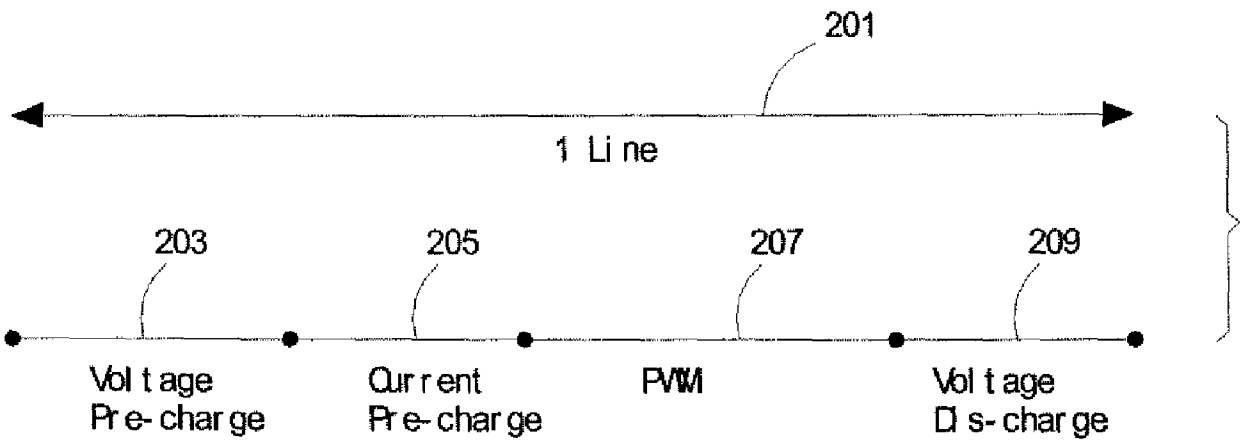
Figure 2 (Prior Art)
FIG. 2 shows a timing diagram representating a conventional PWM technique is used to drive a PMOLED pixel.

In a driver IC used to drive a PMOLED, a technique called pulse width modulation (PWM) is often used to display different gray levels. Referring now to FIG. 2, there is shown a timing diagram representating a conventional PWM technique used to drive a PMOLED pixel.

Typically, there are four stages when a driver IC drives to display a line 201 of the PMOLED pixels as shown in the figure.

1. Voltage Pre-charge stage 203: first, in this stage, a voltage exceeding the threshold voltage of the OLED is provided in order to display a line of the PMOLED pixels.
2. Current Pre-charge stage 205: in this stage, a current, preferably constant, is provided to the OLED in order to adjust different levels of different colors R, G, or B, as well as the initial voltage of the PMOLED.
3. PWM stage 207: in this stage, a current, preferably constant, is provided to the OLED, and the gray level is adjusted by the current driving time. For example, if the OLED can display 64 gray levels, the current driving time could be divided into 64 intervals.
4. Voltage Dis-charge stage 209: in this stage, the previously charged voltage across the OLED now could be discharged in order to prepare to charge the next line.

As discussed above, a constant current is preferably provided to the OLED in both the Current Pre-charge and PWM stages, only changing the current driving time in order to display different gray levels.

Figure 3:
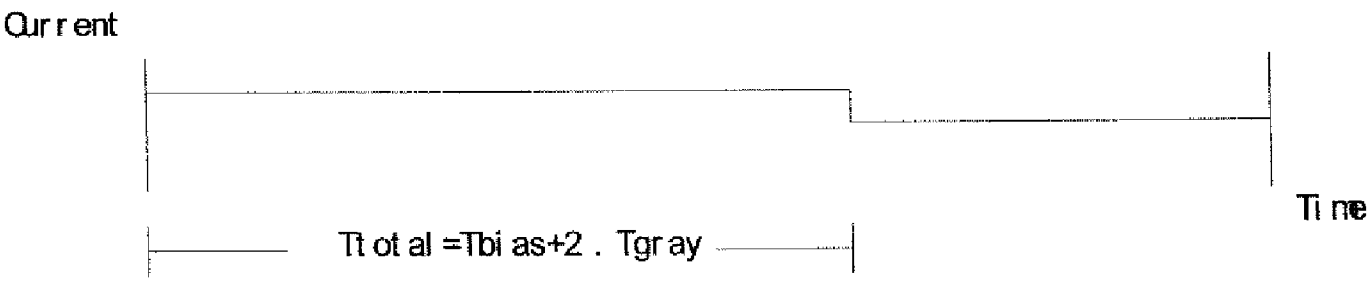
Figure 3 (Prior Art)
FIG. 3 shows a timing diagram representating a conventional PWM technique used to drive a PMOLED pixel during a constant current drive stage.

Referring now to FIG. 3, there is shown a timing diagram representating a conventional PWM technique used to drive a PMOLED pixel during a constant current drive stage. The current driving time and gray level relationship is obtained through an empirical equation based on OLED material characteristics. For example, in one embodiment, the current driving time $T_{total}$ obtained from an empirical equation is equal to current pre-charge time $T_{bias}$ plus twice the gray level time $T_{gray}$ as the following equation illustrates:

$$T_{total}=T_{bias}+2T_{gray} \quad (1)$$

For example, to display a red channel, $T_{bias}$ could be programmed to 5.

Therefore, when gray level=1, Ttotal=5+2*1=7

When gray level=2, Ttotal=5+2*2=9

Similarly, to display a green channel, T bias is programmed to 9.

Therefore, when gray level=1, $T_{total}$=9+2*1=11

When gray level=2, $T_{total}$=9+2*2=13

To implement such a driving scheme, a conventional hardware structure is used.

Figure 4:
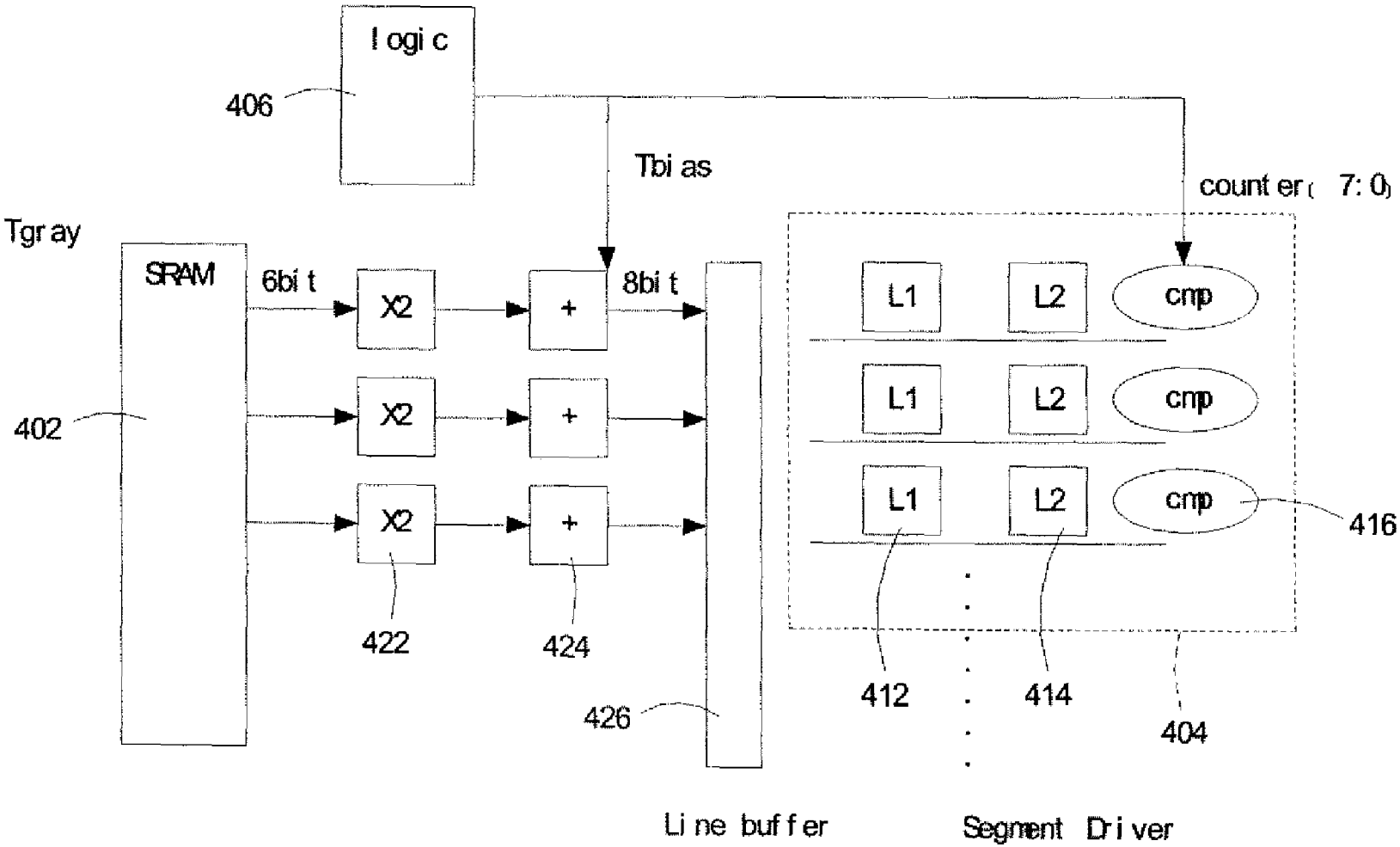
Figure 4 (Prior Art)
FIG. 4 illustrates a hardware schematic diagram representating a conventional PWM implemention.

Referring now to FIG. 4, there is shown a hardware schematic diagram representating a conventional PWM technique implementation. In this exemplary embodiment of a cell phone panel driver IC, the structure includes three main functional blocks of SRAM 402, Segment Driver 404 and Logic 406.

The value of the gray level time $T_{gray}$ described before is stored in the SRAM 402, while the value of the current pre-charge time $T_{bias}$ is stored in the Logic 406. The Segment Driver 404 may include two levels of latches L1 412, L2 414 and a comparator cmp 416 for each color R, G, B as shown in the figure. The Logic 406 provides the control signals such as the current pre-charge time $T_{bias}$ and a counter value to the other two functional blocks, SRAM 402, and Segment Driver 404. In one embodiment, the gray level time $T_{gray}$ stored in the SRAM 402 is of 6 bits, and the counter is of 8 bits.

In operation, a 6-bit gray level value $T_{gray}$ is first read from the SRAM 402 and sent to the multiplexer 422. The multiplexer 422 outputs a $T_{value}$ which is equal to 2*$T_{gray}$, and then adds the value of the current pre-charge time $T_{bias}$ from the Logic 406 in an adder 424. That adder 424 outputs the current drive time $T_{total}$ in the PWM stage. The current driver time $T_{total}$ is then sent from a 8-bit line buffer 426 to the Segment Driver 404. When the 8-bit data reaches the L2 latch 414 of the Segment Driver 404, a constant current is provided to the OLED. Finally, the counter value is increment by one after each cycle until its value reaches the current drive time $T_{total}$. The comparator cmp 416 instructs the Segment Driver 404 to shut off the current when the counter value equals to the current drive time $T_{total}$.

Figure 5:
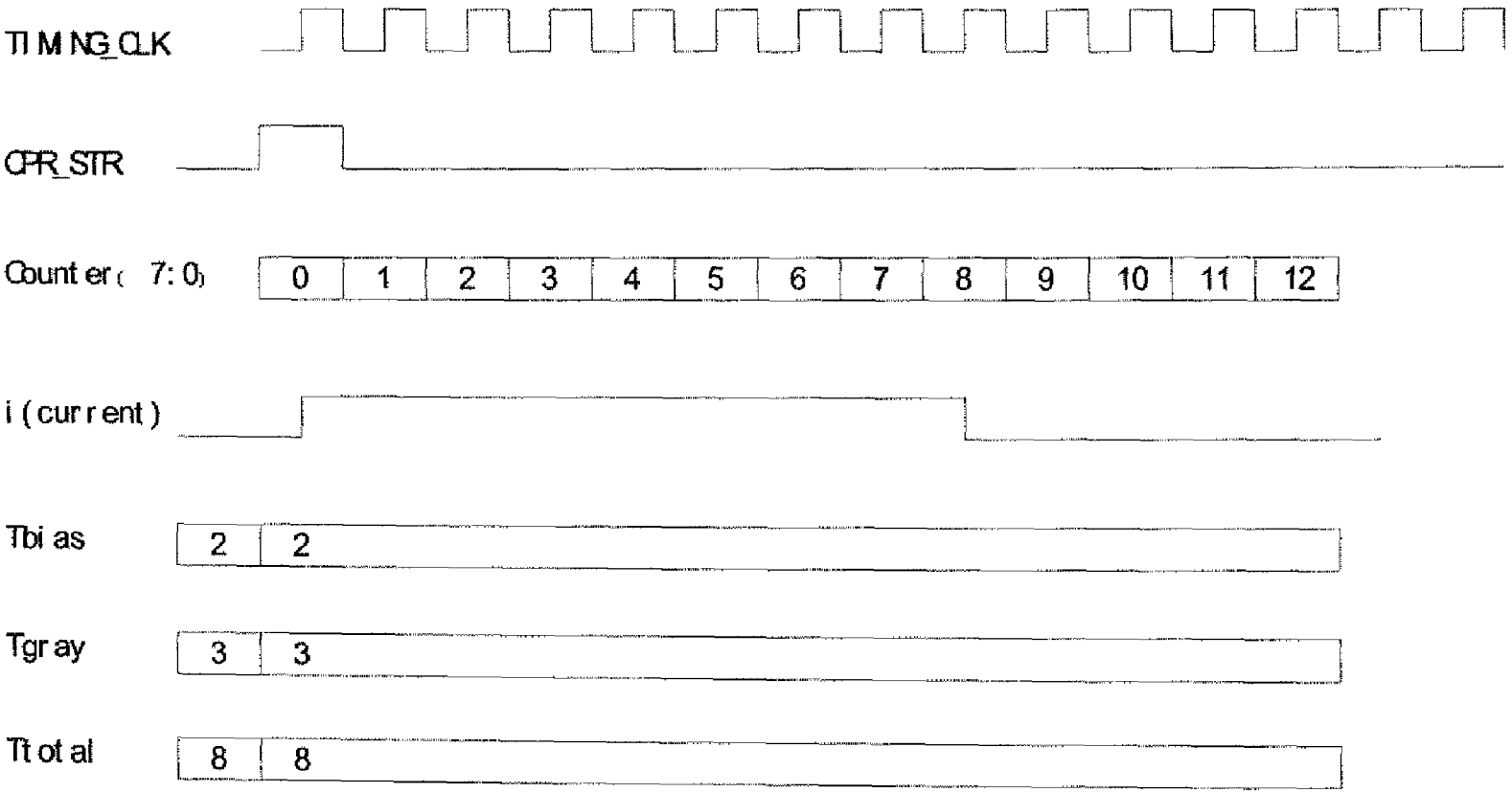
Figure 5 (Prior Art)
FIG. 5 shows a timing diagram representating a conventional PWM technique used to drive a PMOLED pixel.

Referring now to FIG. 5, there is shown a timing diagram representation of how the conventional PWM technique is used to drive a PMOLED pixel. In this example, charge time $T_{bias}$ is set to 2 and the gray level time $T_{gray}$ is set to 3. Therefore, the current driving time $T_{total}$ which is equal to the value of the current pre-charge time $T_{bias}$ plus twice the gray level time $T_{gray}$ can be calculated from equation (1). A constant current is then provided to the OLED from clock timing cycle 0 until the value of the counter is reached the value of current driving time $T_{total}$ in clock cycle 8 as shown in the figure.

However, it needs one set of multiplexer and an adder for each channel in such a structure. It therefore increases the die size as well as the cost of the driver IC. To improve the drawbacks of the conventional hardware structure, a new hardware structure and driving method of the present invention is disclosed for such a purpose.

Figure 6:
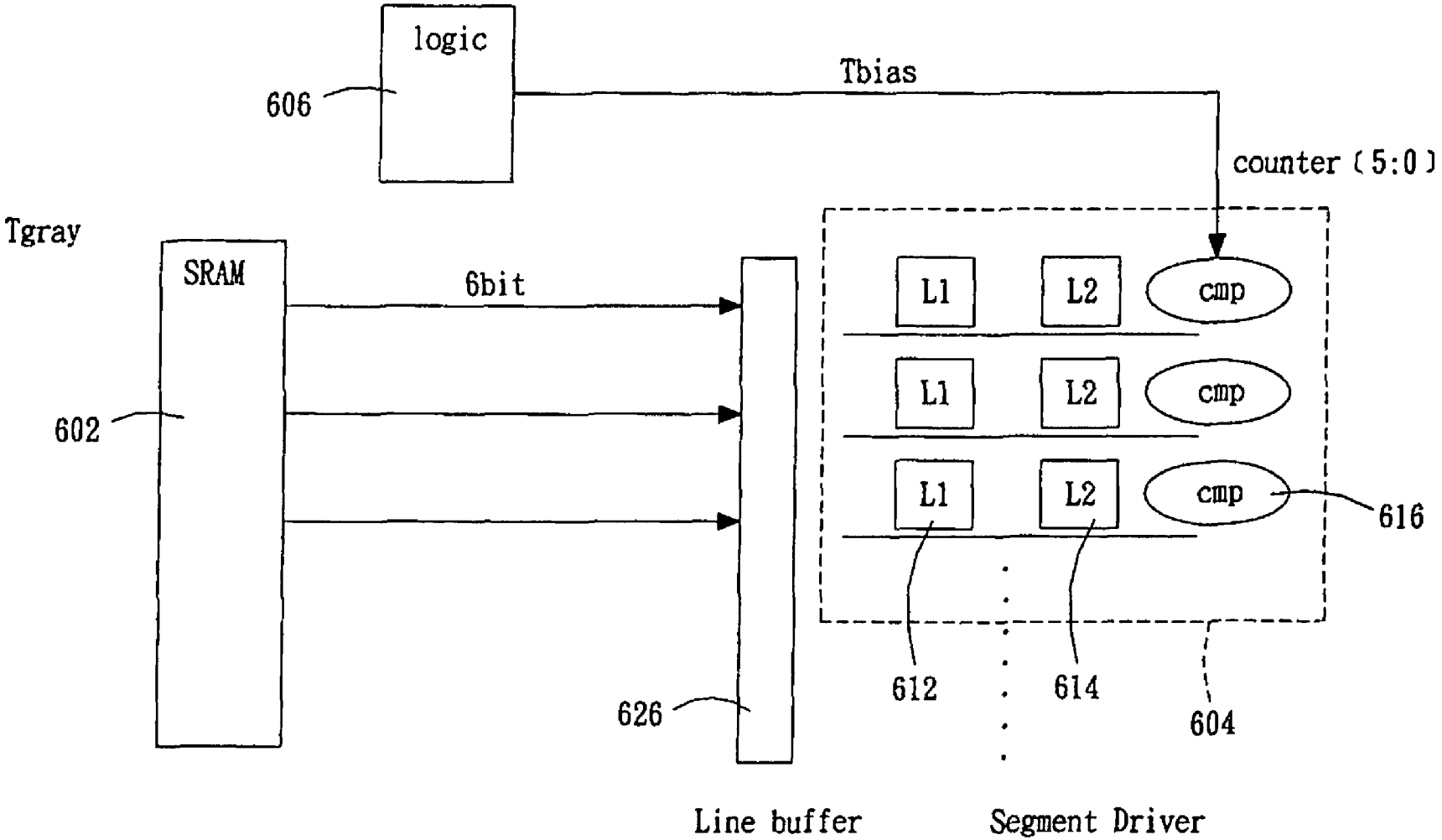
FIG. 6 illustrates a hardware schematic diagram representating a PWM implementation, according to a preferred embodiment of the present invention.

Referring now to FIG. 6, there is shown a hardware schematic diagram representating a PWM implementation according to a preferred embodiment of the present invention. In this exemplary embodiment of a cell phone panel driver IC, the structure still includes three main functional blocks of SRAM 602, Segment Driver 604 and Logic 606.

The value of the gray level time $T_{gray}$ described before is stored in the SRAM 602, while the value of the current pre-charge time $T_{bias}$ is stored in the Logic 606. The Segment Driver 604 may include two levels of latches 612, and 614 and a comparator cmp 616 for each color R, G, B, as shown in the figure. The Segment Driver 604 should comprise multi-channels in the structure, the figure just shows three channels as an example. The Logic 606 provides the control signals such as the current pre-charge time $T_{bias}$ and a counter value to only the Segment Driver 604. In one embodiment, the gray level time $T_{gray}$ stored in the SRAM 402 is of 6 bits, and in the counter is also of 6 bits.

In operation, a gray level value $T_{gray}$ is first read from the SRAM 602 and sent directly to the Segment Driver 604 through a line buffer 626. When the data reaches the L2 latch 614 of the Segment Driver 604, the counter is reset to zero and a constant current is provided to the OLED. Finally, the counter value is first counted zero for the current pre-charge time $T_{bias}$ and then increments by one in every two cycles until its value reaches the gray level value $T_{gray}$. The comparator 616 instructs the Segment Driver to shut off the current when the counter value equals to the gray level value $T_{gray}$. In this way, the multiplexer and the adder of the prior art can be removed.

Figure 7:
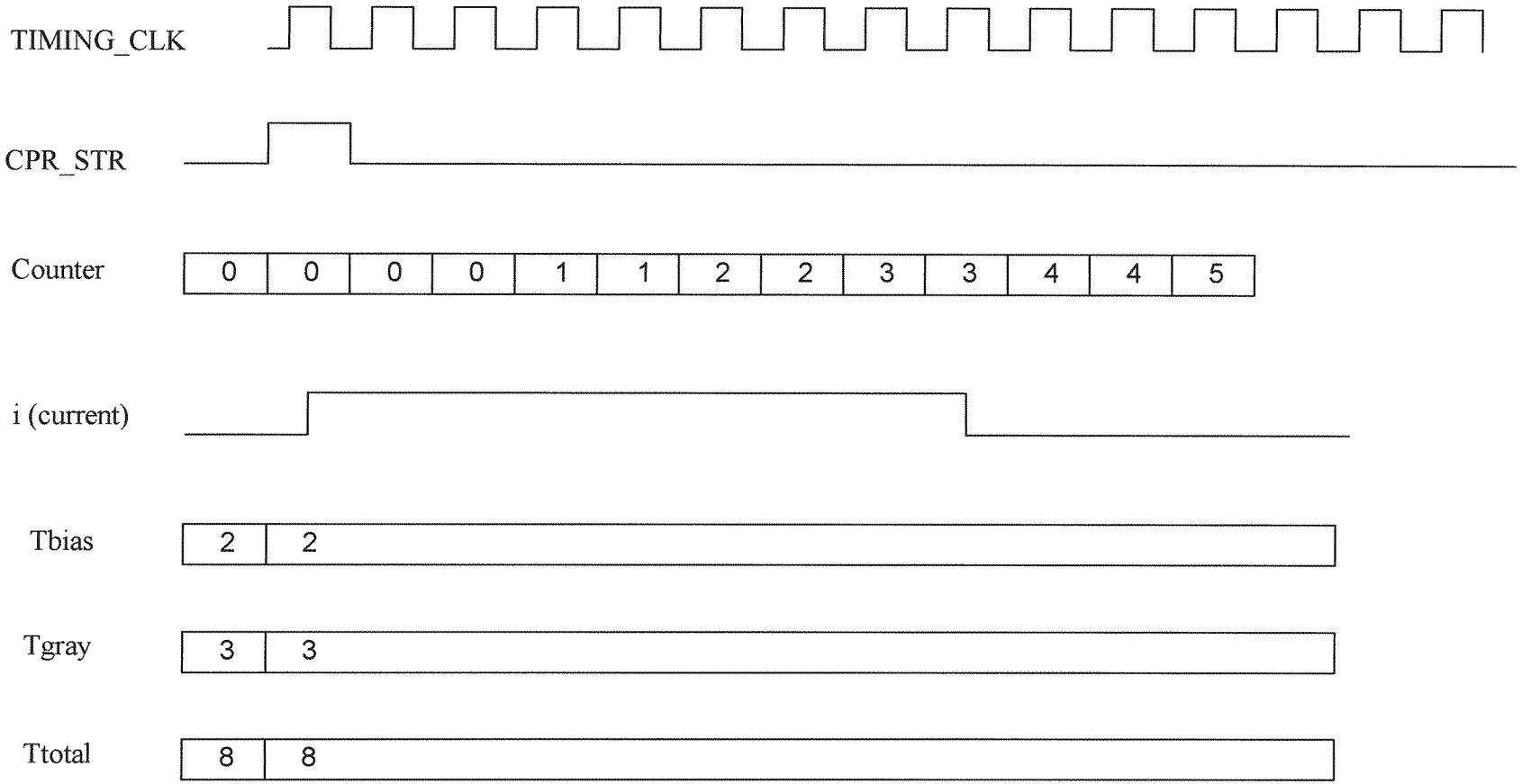
FIG. 7 illustrates a timing diagram representating a PWM technique used to drive a PMOLED pixel according to a preferred embodiment of the present invention.

Referring now to FIG. 7, there is shown a timing diagram representating a PWM technique used to drive a PMOLED pixel according to a preferred embodiment of the present invention. In this example, the current pre-charge time $T_{bias}$ is set to 2 and the gray level time $T_{gray}$ is set to 3. Therefore, from equation (1), the current driving time $T_{total}$ during which current is supplied to the OLED can be calculated as being equal to the value of the current pre-charge time $T_{bias}$ plus twice the gray level time $T_{gray}$ . A start signal CPR_STR is activated to trigger current supply to the OLED. In response to the start signal CPR_STR, the counter is first counted zero for two cycles of the clock signal TIMING_CLK which is equal to the current pre-charge time $T_{bias}$, and then increments by one in every two cycles. A constant current (represented by the signal i(current) in FIG. 7) is also provided to the OLED in response to the start signal CPR_STR, and is continued until the value of the counter reaches the value of the gray level time $T_{gray}$ (i.e., equal to 3) as shown in the figure.

Figure 8:
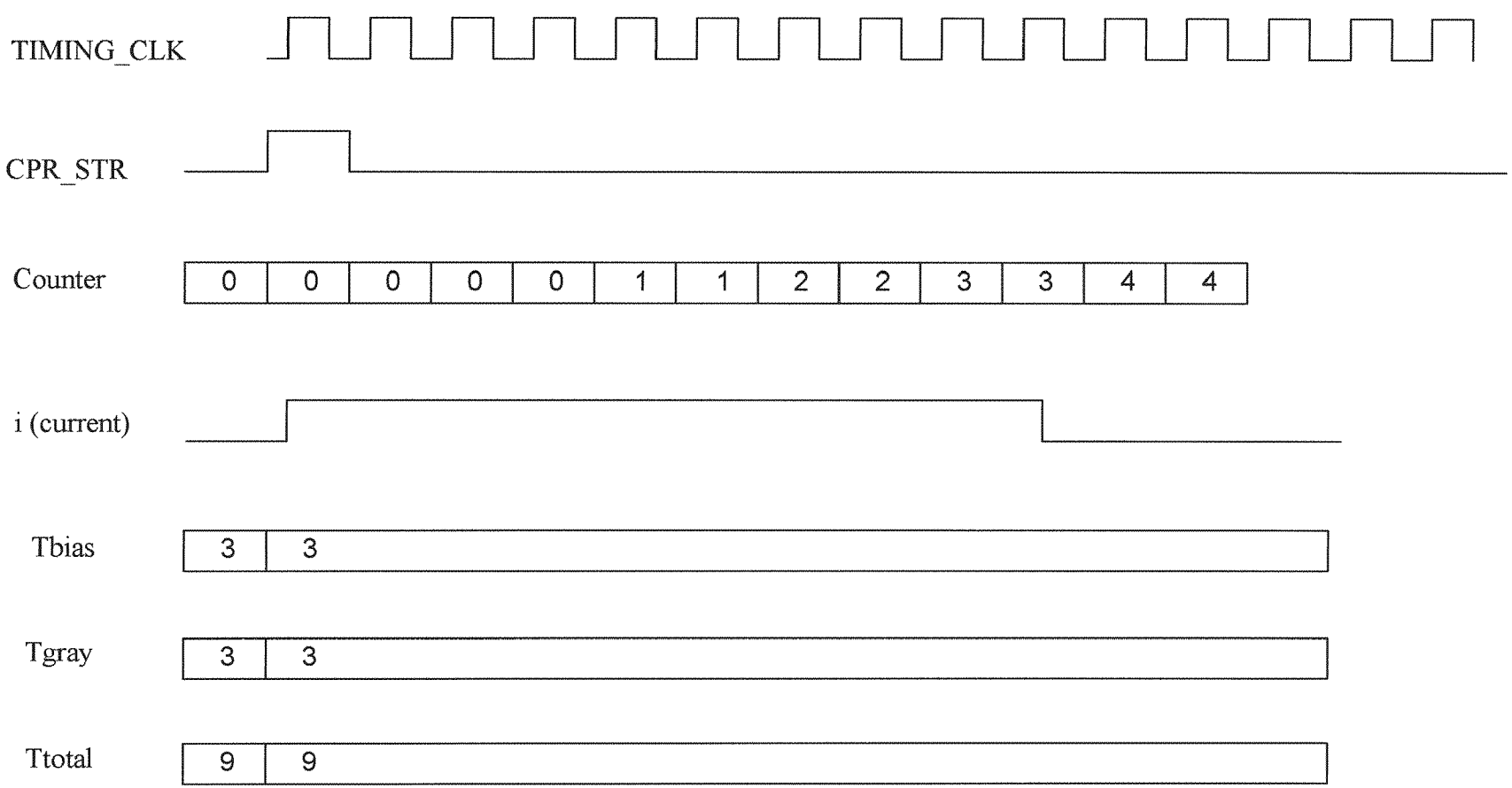
FIG. 8 illustrates a timing diagram representating a PWM technique used to drive a PMOLED pixel according to another embodiment of the present invention.

Referring now to FIG. 8, there is shown a timing diagram representating a PWM technique used to drive a PMOLED pixel, according to another embodiment of the present invention. In this example, the current pre-charge time $T_{bias}$ is now set to 3 and the gray level time $T_{gray}$ is still set to 3. Therefore, the current driving time $T_{total}$ should be 9 clock cycles of the clock signal TIMING_CLK in this example. After the start signal CPR_STR is activated, the counter is first counted zero for three cycles which is equal to the current pre-charge time $T_{bias}$, and then increments by one in every two cycles. A constant current (represented by the signal i(current) in FIG. 7) is also provided to the OLED in response to the start signal CPR_STR and is continued until the value of the counter reaches the value of the gray level time $T_{gray}$ (i.e.,equal to 3) as shown in the figure.

The current driving time $T_{total}$ obtained from the linear relationship of the current pre-charge time $T_{bias}$ and the gray level time $T_{gray}$ of equation (1) is an example of the present invention. Alternatively, other types of relationships between the current pre-charge time $T_{bias}$ and the gray level time $T_{gray}$ can also be used as well. For example, a set of look up tables which store the predetermined values of the relationships between the current pre-charge time $T_{bias}$ and the gray level time $T_{gray}$ can also be used.

Finally, those skilled in the art should appreciate that they can readily use the disclosed invention and specific embodiments as a basis for designing or modifying other structures for carrying out the same purpose of the present invention without departing from the spirit and scope of the present invention as defined by the appended claims.

What is claimed is:

1. A driving circuit using a pulse width modulation (PWM) technique for a light emitting device, comprising:

a memory for storing a data value representative of a desired gray level time;

a logic for providing a counter value that is kept in an initialized state during all of a predetermined current pre-charge period of time, during which current is supplied to the light emitting device for pre-charging the device, and periodically updated after elapse of said current pre-charge period of time; and a segment driver for providing a constant current to said light emitting device during said current pre-charge period of time and continuing to provide current to said light emitting device after elapse of said current pre-charge period of time until said counter value reaches said data value representative of said desired gray level time.

2. The driving circuit of claim 1, wherein said light emitting device comprises an organic light emitting diode (OLED).

3. The driving circuit of claim 2, wherein said organic light emitting diode comprises a passive matrix organic light emitting display (PMOLED).

4. The driving circuit of claim 1, wherein said memory comprises a static random access memory (SRAM).

5. The driving circuit of claim 1, wherein said logic is configured to periodically update said counter value based on a multiplication factor associated with said gray level time.

6. The driving circuit of claim 5, wherein said counter value is updated once every number of clock cycles that is multiple of the multiplication factor.

7. The driving circuit of claim 1, wherein said segment driver further comprises a comparator.

8. The driving circuit of claim 1, wherein said segment driver is configured to provide a constant current to said light emitting device based on a look up table of said desired gray level time and said current pre-charge period of time.

9. A driving circuit using a pulse width modulation (PWM) technique for a light emitting device, comprising:

a memory for storing a data value representative of a desired gray level time;

a logic comprising a counter configured to track a parameter representative of an amount of elapsed time, wherein the counter is configured to remain in an initialized state during all of a predetermined current pre-charge period of time, during which current is supplied to the light emitting device for a number of clock cycles for pre-charging the device, and to periodically update once every number of clock cycles that is multiple of a multiplication factor associated with the gray level time after elapse of the current pre-charge period of time; and a segment driver for providing a constant current to said light emitting device during said current pre-charge period of time and continuing to provide current to said light emitting device after elapse of the current pre-charge period of time until said counter reaches said data value representative of said desired gray level time.

10. The driving circuit of claim 9, wherein said light emitting device comprises an organic light emitting diode (OLED).

11. The driving circuit of claim 10, wherein said organic light emitting diode comprises a passive matrix organic light emitting display (PMOLED).

12. The driving circuit of claim 9, wherein said memory comprises a static random access memory (SRAM).

13. The driving circuit of claim 9, wherein said segment driver further comprises a comparator.

14. A current driving method using a pulse width modulation (PWM) technique to display a desired gray level for a light emitting device, the method comprising:

providing a data value representative of a desired gray level time;

providing electric current to the light emitting device for pre-charging said light emitting device during a predetermined current pre-charge period of time;

keeping a counter value in an initialized state during all of said current pre-charge period of time;

periodically updating said counter value after elapse of said current pre-charge period of time; and continuing to provide current to said light emitting device after elapse of the current pre-charge period of time until the counter value reaches the data value representative of the desired gray level time.

15. The current driving method of claim 14, wherein said light emitting device comprises an organic light emitting diode (OLED).

16. The current driving method of claim 15, wherein said OLED comprises a passive matrix organic light emitting device (PMOLED).

17. The current driving method of claim 14, wherein said current is provided to said light emitting device based on a look up table of said desired gray level time and said current pre-charge period of time.

18. The current driving method of claim 14, wherein said counter value is periodically updated based on a multiplication factor associated with the gray level time.

19. The current driving method of claim 18, wherein said counter value is updated once every number of clock cycles that is multiple of the multiplication factor.

* * * * *